US006002092A

United States Patent [19]

Pan

[11] Patent Number: 6,002,092

[45] Date of Patent: Dec. 14, 1999

[54] KEYSWITCH KEY APPARATUS

[76] Inventor: Hua-Tseng Pan, 930 W. Maude Ave., Sunnyvale, Calif. 94086

[21] Appl. No.: 09/081,584

[22] Filed: May 19, 1998

[30] Foreign Application Priority Data

May 19, 1997 [TW] Taiwan ..... 86106788
Jun. 5, 1997 [TW] Taiwan ..... 86209404

[51] Int. Cl.[6] ..... H01H 13/70

[52] U.S. Cl. ..... 200/344; 200/344

[58] Field of Search ..... 361/689–711

[56] References Cited

U.S. PATENT DOCUMENTS 5,671,120 9/1997 Kikinisi ..... 361/687

5,695,047 12/1997 Tanahashi ..... 200/344

*Primary Examiner*—Michael L. Gellner
*Assistant Examiner*—Nhung Nguyen

[57] ABSTRACT

A keyswitch key includes a thin circuit film comprising a pressure-sensitive switch and at least a first hole defined in the film away from the switch. A metallic base frame is positioned under the film and includes at least one retention member extending through the at least a first hole of the film. An activation mechanism includes a lower portion located on the film and supported by the at least one retention member of the base frame. The activation mechanism is operative to activate/deactivate the switch upon application/release of a manual depression.

4 Claims, 7 Drawing Sheets

KEYSWITCH KEY APPARATUS

BACKGROUND OF THE INVENTION

1. Field of the Invention

The present invention relates to a keyswitch key apparatus, and particularly to a keyswitch key apparatus having a compact size and heat sink capabilities.

2. The Prior Art

Keyswitch keys are basic elements of a keyboard which is the most common input device of a portable (notebook) computer. Most portable computers face two problems arising from compact-size requirements and proper heat dissipation. A conventional keyswitch key 99 as shown in FIG. 1 comprises a keycap 12, a scissors-like mechanism 14 operatively engaged between the keycap 12 and a plastic supporting frame 20, and an elastic element 16 linked to the keycap 12 and responding to a click therefrom to depress a pressure-sensitive switch 32 in a thin circuit film 30 which is positioned on a metal plate 40. A keyswitch key having the above conventional structure works well, however, the conventional structure does not address the problems arising from compact-size requirements or proper heat dissipation of portable computers. Specifically, the plastic supporting frame 20 of the conventional keyswitch key usually occupies a considerable amount of space. The above problems may be overcome if the metal plate 40 and the plastic supporting frame 20 can be combined into a single member which is conductive as well as capable of providing a supporting function similar to the scissiors-like mechanism 14. The combination of the supporting frame 20 and the metal plate 40 can also fully eliminate the need for screw bolts (not shown) which retain the supporting frame 20 on the metal plate 40. Further more, the elimination of the plastic supporting frame 20 will considerably reduce mold manufacturing costs.

Therefore, a combined structure of the supporting frame and the metal plate is required to replace the present plastic supporting frame and the metal plate.

SUMMARY OF THE INVENTION

The primary purpose of the present invention is to provide an improved keyswitch key structure which can reduce the space occupied thereby resulting in a compact size and lower manufacturing costs.

Another purpose of the present invention is to provide an improved keyswitch key of a keyboard which can also serve as a supplemental heat sink for a portable computer.

In accordance with one aspect of the present invention, a keyswitch key includes thin circuit film comprising a pressure-sensitive switch and at least a first hole defined in the film away from the switch. A metallic base frame is positioned under the film and includes at least one retention member extending through the at least a first hole of the film. An activation mechanism includes a lower portion located on the film and supported by the at least one retention member of the base frame. The activation mechanism is operative to activate/deactivate the switch upon application/release of a manual depression.

DETAILED DESCRIPTION OF THE PREFERRED EMBODIMENTS

Figure 2:
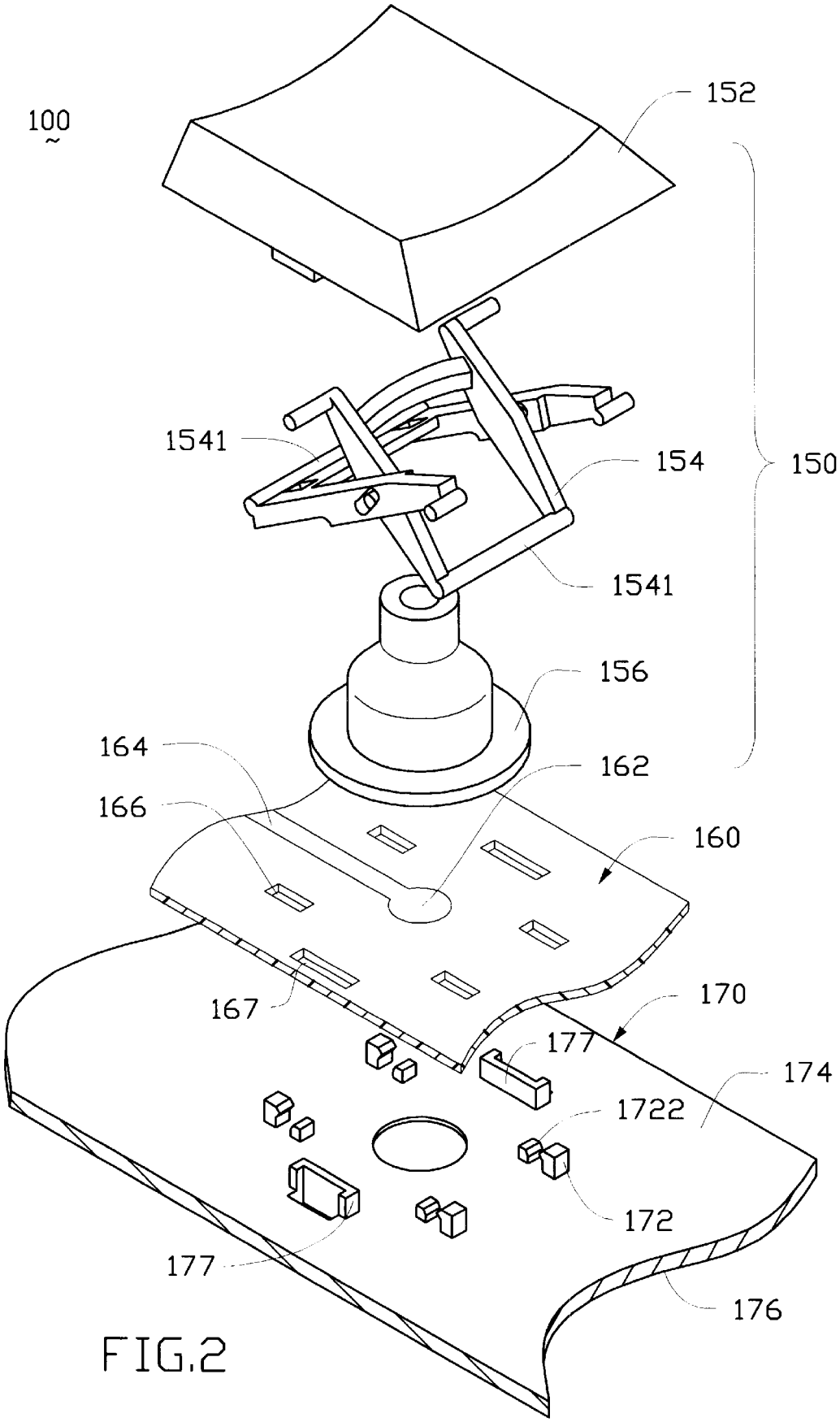
FIG. 2 is an exploded view of a first embodiment of a keyswitch key in accordance with the present invention.

Reference will now be made in detail to the drawings. It will be noted here that for referring to FIG. 2, a keyswitch key 100 in accordance with the present invention comprises an activation mechanism 15, a thin circuit film 160, and a base frame 170. The activation mechanism 15 comprises a keycap 152 from which two tabs 153 extend downward, a scissors-like mechanism 154, and an inverted bowl-like elastic member 156 having a stub 158 (shown in FIG. 3) extending downward from an inner portion thereof. The film 160 comprises at least one pressure-sensitive switch 162, one printed foil 164 and a plurality of first holes 166 and second holes 167. The base frame 170 is made of metal, such as Mg—Al alloy, via a press molding procedure and comprises a first surface 174 and a second surface 176 opposite the first surface 174. The first surface 174 comprises four retention members 172 each of which comprises two appropriately spaced protrusions 1722 for pivotably receiving a bottom linkage bar 1541 of the scissors-like mechanism 154 therebetween. Two guiding sockets 177 are formed on the first surface 174 of the base frame 170 for slidably receiving the tabs 153 of the keycap 152 when the keycap 152 is depressed. The film 160 is positioned on the first surface 174 of the base frame 170 with the first holes 166 and the second holes 167 respectively receiving the retention members 172 and the guiding sockets 177. The switch 162 is centered between the four retention members 172. The frame 170 exhibits favorable heat sink capabilities because of the exposure of the retention members 172 and the guiding sockets 177 through the film 160.

Figure 3:
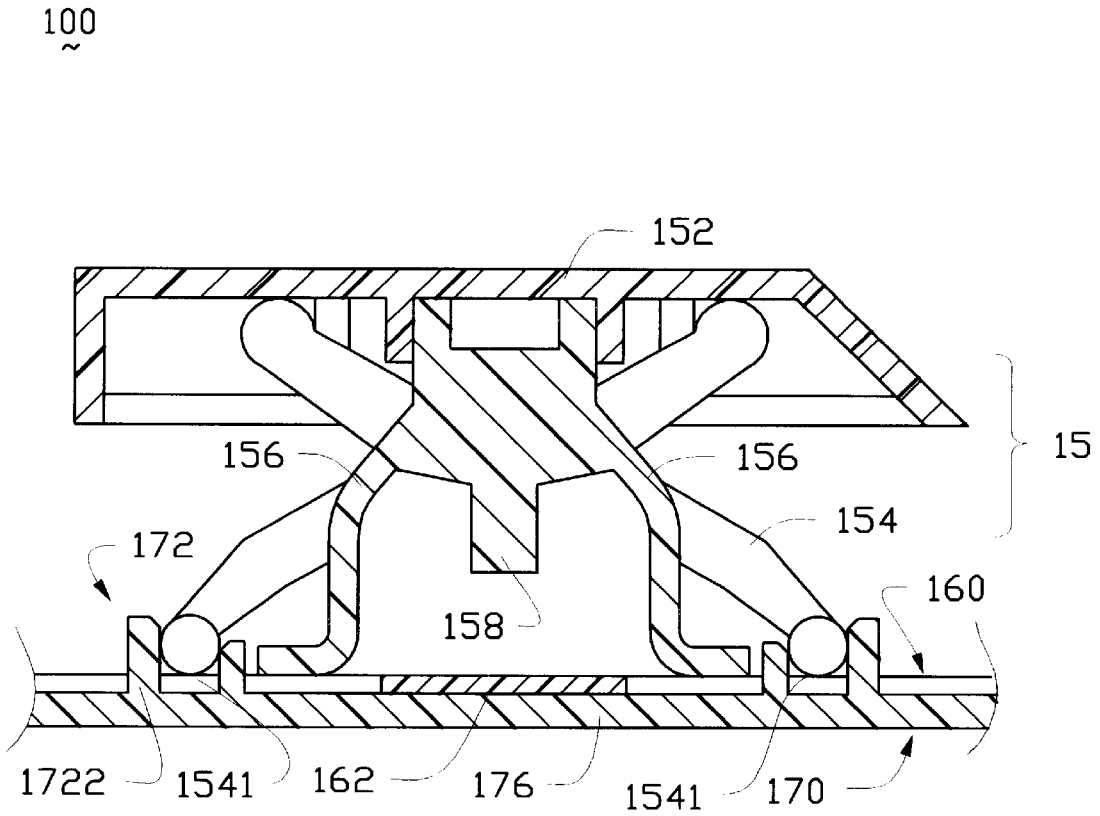
FIG. 3 is a cross-sectional view of the assembled keyswitch key of FIG. 2.

FIG. 3 further illustrates the structure and function of the keyswitch key 100. Depression of the keycap 152 lowers the scissors-like mechanism 154 and deforms the elastic member 156, thus causing the stub 158 to depress the switch 162 which in turn changes to an activated status and transmits an "activated" signal to the printed foil 164. When the depression on the keycap 152 is removed, the elastic member 156 resumes its original shape and the switch 162 returns to its deactivated status.

Figure 4:
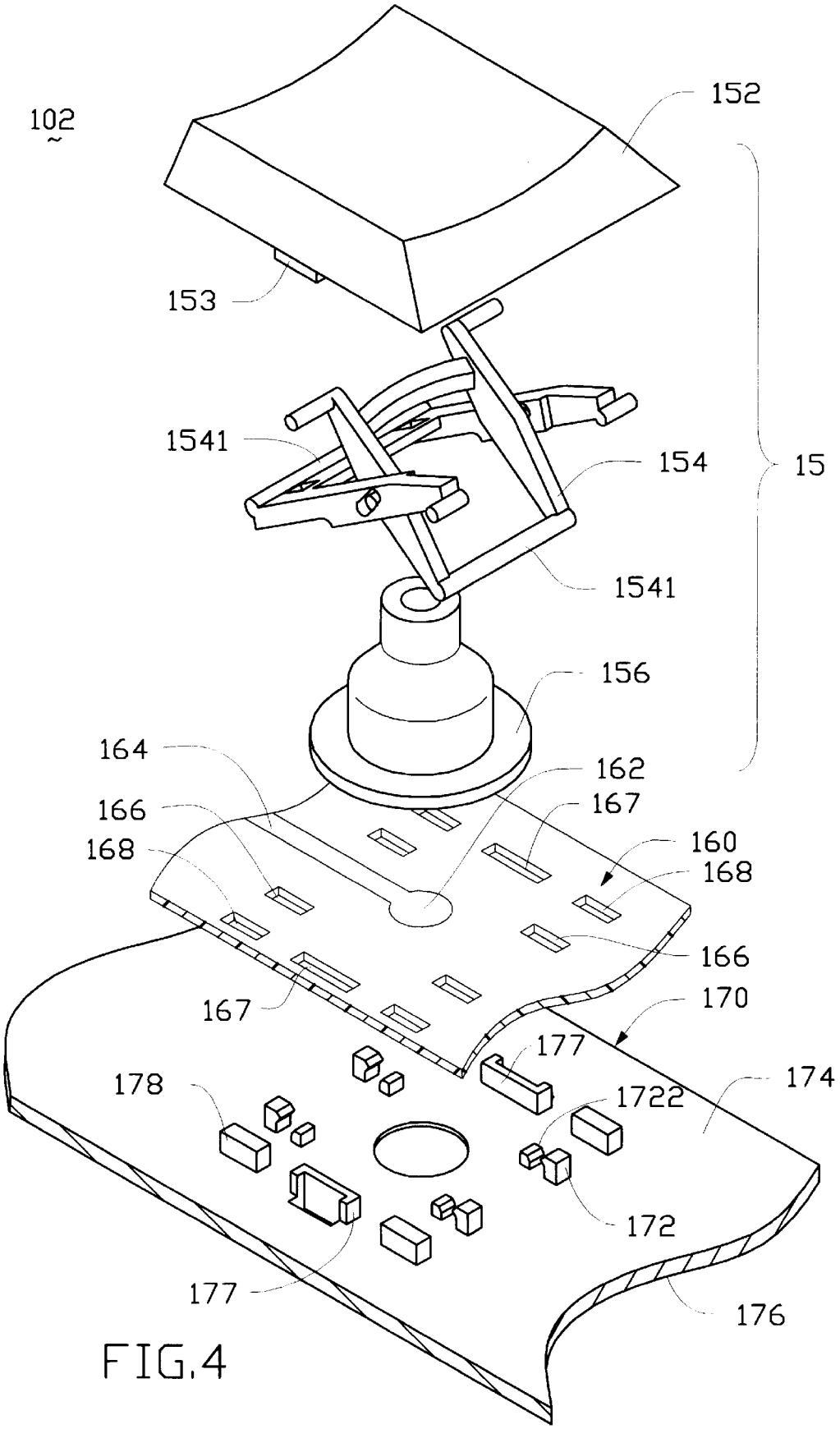
FIG. 4 is an exploded view of a second embodiment of a keyswitch key in accordance with the present invention.

Referring to FIG. 4, a second embodiment of a keyswitch key 102 is similar to the first embodiment except for some added features of the film 160 and the base frame 170. In the second embodiment, four additional metal protrusions 178 project from the base frame 170 for enhancing the heat sink capability of the base frame 170, and four additional holes 168 are defined in the film 160 for receiving the four metal protrusions 178 when the film 160 is positioned on the base frame 170. In this embodiment, the base frame 170 exhibits better heat sink capabilities than the first embodiment resulting from the additional protrusions 178 projecting through the film 160.

Figure 5:
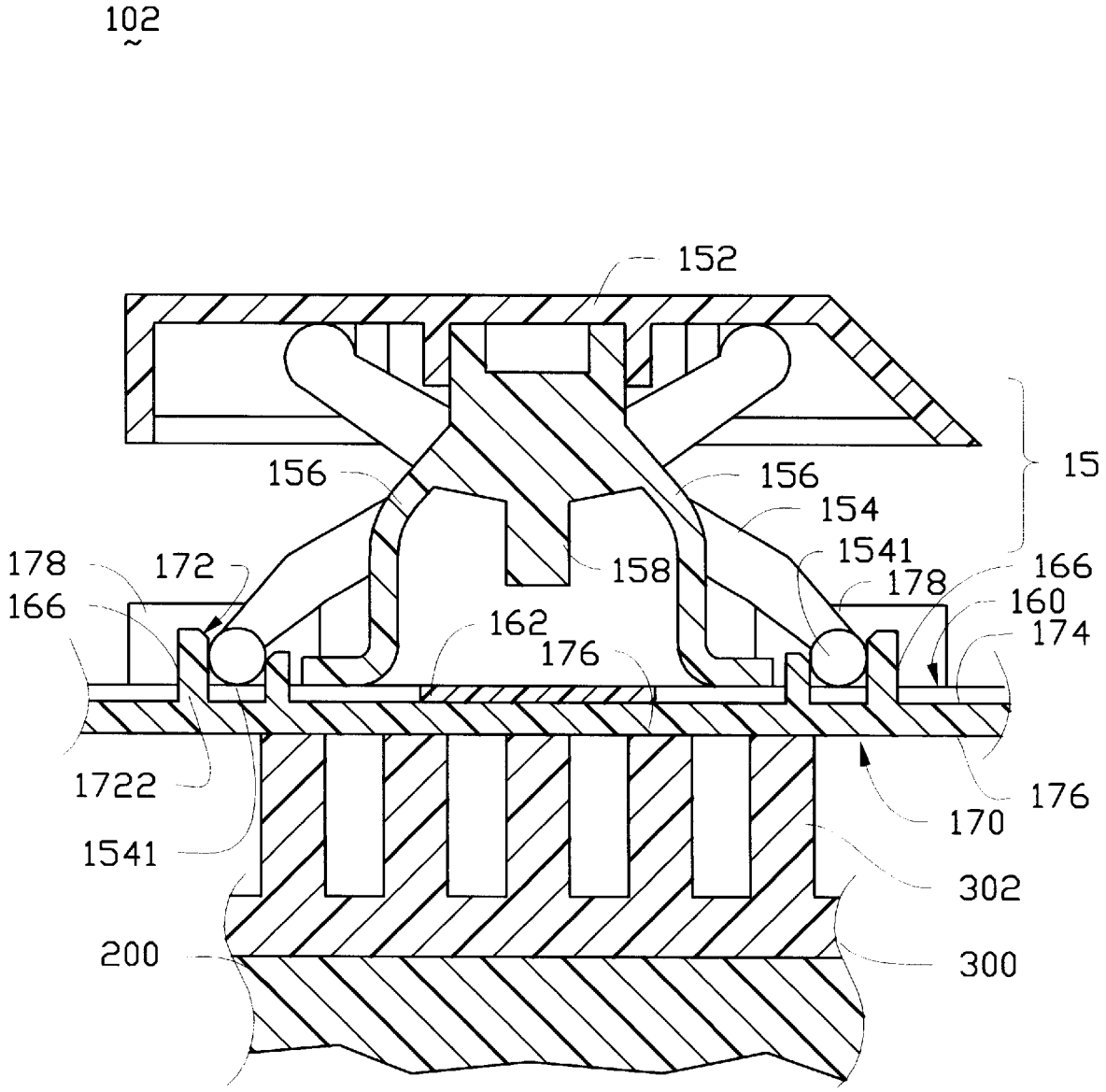
FIG. 5 is a cross-sectional view of the assembled keyswitch key of FIG. 4.

FIG. 5 shows the second embodiment of the keyswitch key 102 connected to an electrical device 200 via an external heat sink 300 which includes a plurality of ribs 302 projecting upward. The heat generated from the electrical device 200 will be transferred from the external heat sink 300 to the base frame 170 and dissipated into the air. Therefore, the keyswitch key 102 can effectively facilitate the dissipation of heat generated from the electrical device 200.

Figure 6:
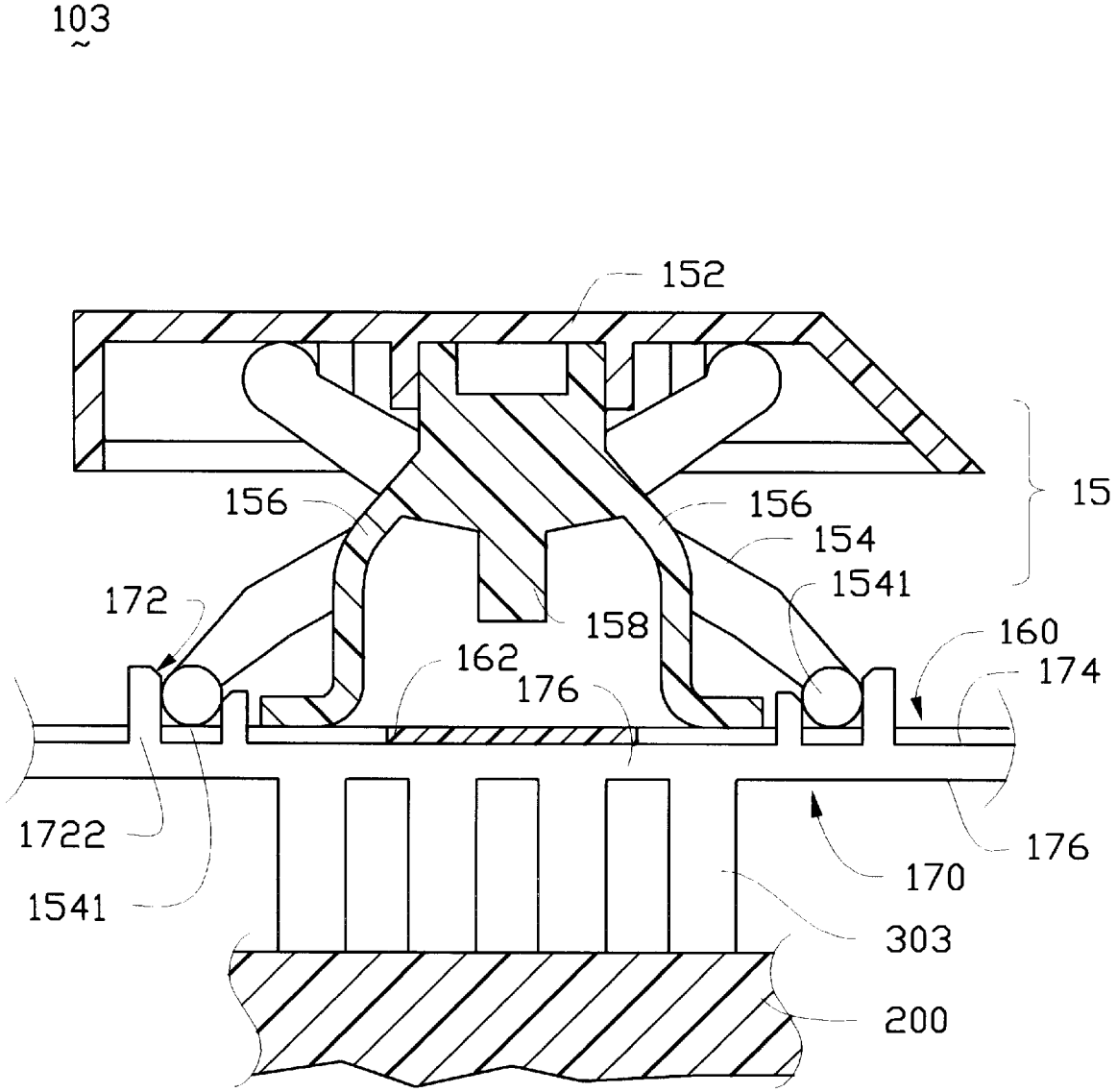
FIG. 6 is a cross-sectional view of an assembled keyswitch key in accordance with a third embodiment of the present invention.

Referring to FIG. 6, a third embodiment of a keyswitch key 103 in accordance with the present invention is shown, wherein a plurality of ribs 303 extend downward from the base frame 170 for attaching to the electrical device 200 thereby increasing a heat dissipation area thereof.

Figure 1:
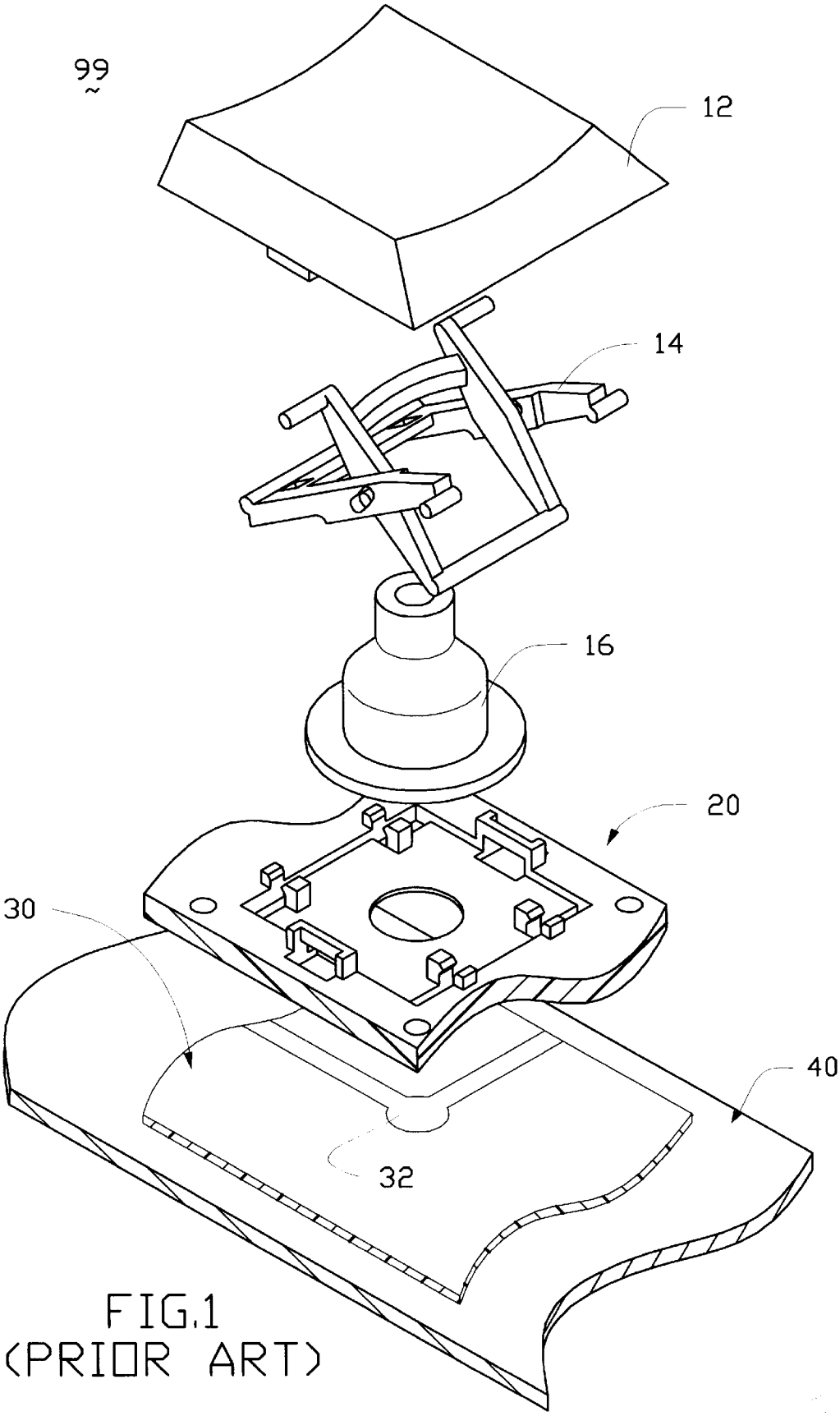
FIG.1 (PRIOR ART)
FIG. 1 is an exploded view of a conventional keyswitch key.
Figure 7:
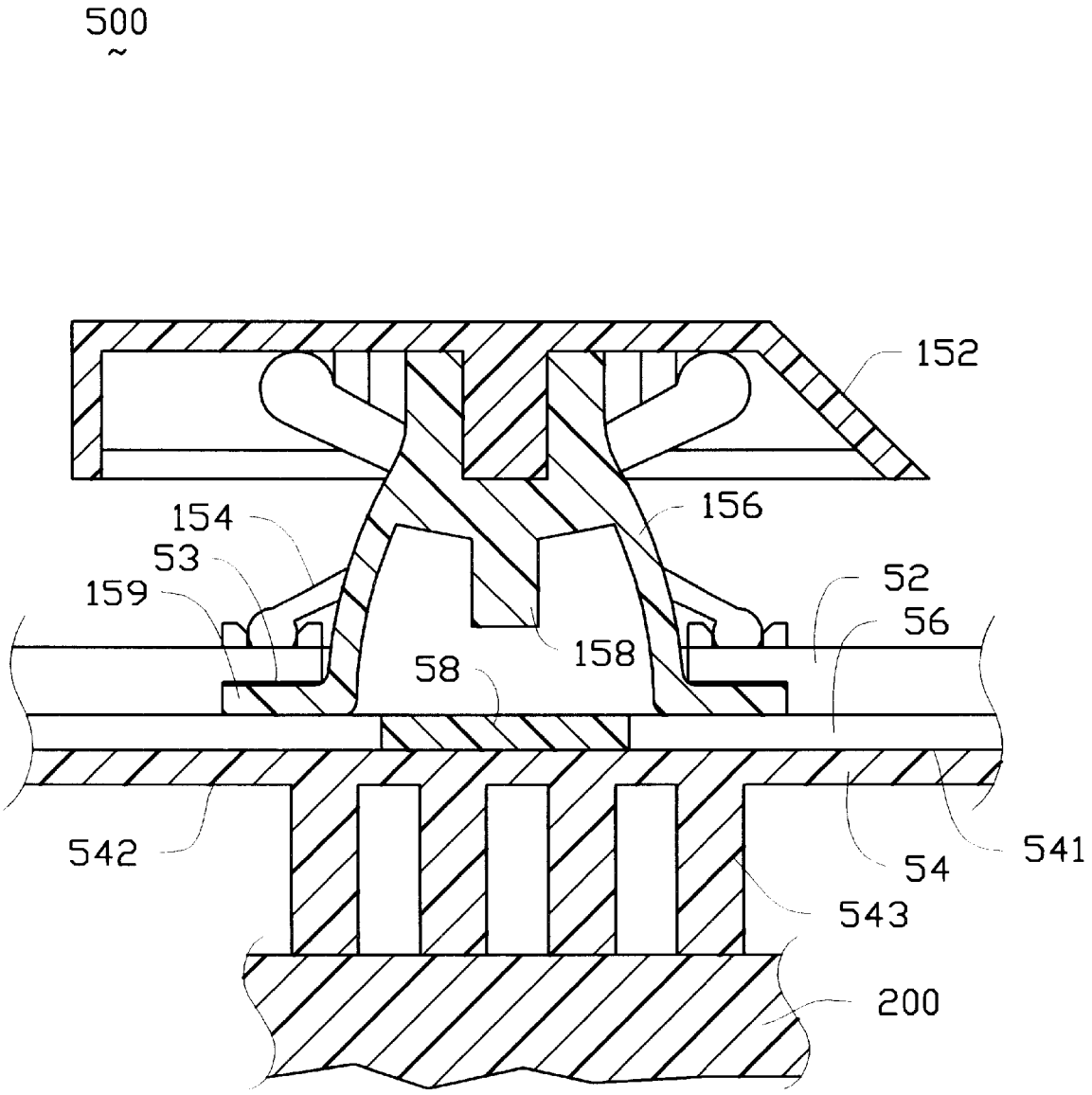
FIG. 7 is a cross-sectional view of an assembled keyswitch key in accordance with a fourth embodiment of the present invention.

Referring to FIG. 7, a fourth embodiment of a keyswitch key 500 in accordance with the present invention is shown, where the keycap 152, the scissors-like mechanism 154, and the elastic member 156 are identical to those of the first embodiment as shown in FIG. 3. The metallic base frame 170 of the first embodiment is changed to a nonconductive base frame 52 which defines a recess 53 in a bottom surface thereof for retaining a flange 159 of the elastic member 156, and the base frame 52 is positioned on a thin circuit film 56. The film 56 including a pressure-sensitive switch 58 is similar to the conventional film 30 as shown in FIG. 1. A heat sink plate 54 which has an upper surface 541 and a lower surface 542 is positioned under the film 56. A plurality of ribs 543 extending downward from the lower surface 542 of the heat sink plate 54 are positioned on an electrical device 200 in order to absorb and dissipate the heat generated by the electrical device 200.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A keyswitch key apparatus comprising:

a thin circuit film comprising a pressure-sensitive switch and at least a first hole defined in the film away from the switch;

a base frame made of Mg—Al alloy and positioned under the film and comprising at least one retention member passing through the at least a first hole of the film;

an activation mechanism supported by the at least one retention member of the base frame and rested on the film and comprising a keycap connected to a scissors-like mechanism and an inverted bowl-like elastic member so that when the keycap is depressed, the scissors-like mechanism and the elastic member deform to a predetermined level thus causing a stub formed within the elastic member to depress and activate the switch in the film, the keycap comprising at least one tab extending downward;

at least one guiding socket formed on the base frame for receiving and guiding the tab extending from the keycap when the keycap is depressed;

whereby the activation mechanism is operative to activate/deactivate the switch upon application/release of a manual depression about the keycap.

2. The keyswitch key as claimed in claim 1, wherein the at least one retention member comprises two protrusions spaced from each other a predetermined distance.

3. The keyswitch key as claimed in claim 1, wherein the base frame comprises at least one protrusion projecting upward for increasing a heat dissipation area thereof and the film comprises at least a second hole defined therein for extension of the at least one protrusion of the base frame therethrough.

4. The keyswitch key as claimed in claim 1, wherein the base frame comprises a plurality of ribs projecting downward therefrom for increasing a heat dissipation area thereof.

* * * * *